US010065096B2

(12) United States Patent
Chen et al.

(10) Patent No.: US 10,065,096 B2
(45) Date of Patent: Sep. 4, 2018

(54) SHUTTLECOCK AND ARTIFICIAL FEATHER THEREOF

(71) Applicant: Victor Rackets Industrial Corp., Taipei (TW)

(72) Inventors: Shu-Jung Chen, Taipei (TW); Tsung-Han Liu, Taipei (TW); Hsin-Chen Wang, Taipei (TW); Jing-Shan Huang, Taipei (TW)

(73) Assignee: Victor Rackets Industrial Corp., Taipei (TW)

( * ) Notice: Subject to any disclaimer, the term of this patent is extended or adjusted under 35 U.S.C. 154(b) by 7 days.

(21) Appl. No.: 15/481,632

(22) Filed: Apr. 7, 2017

(65) Prior Publication Data

US 2017/0291085 A1 Oct. 12, 2017

(30) Foreign Application Priority Data

Apr. 8, 2016 (TW) ..... 105204910 U
Dec. 28, 2016 (TW) ..... 105219840 U

(51) Int. Cl.
*A63B 67/18* (2016.01)
*A63B 67/187* (2016.01)

(52) U.S. Cl.
CPC ..... *A63B 67/187* (2016.01); *A63B 67/18* (2013.01)

(58) Field of Classification Search
CPC ..... A63B 67/18
See application file for complete search history.

(56) References Cited

U.S. PATENT DOCUMENTS 2,734,746 A * 2/1956 Sametz et al. ..... A63B 67/187 473/579
2,830,817 A * 4/1958 Schoberl ..... A63B 67/18 473/579
3,891,215 A * 6/1975 Maconachie ..... A63B 67/187 473/579
4,305,589 A * 12/1981 Popplewell ..... A63B 67/193 473/579
8,105,185 B2 * 1/2012 Tanaka ..... A63B 67/193 473/579

* cited by examiner

*Primary Examiner* — John Ricci
(74) *Attorney, Agent, or Firm* — Alan D. Kamrath; Kamrath IP Lawfirm, P.A.

(57) ABSTRACT

A plurality of artificial feathers connects to a plurality of stems and a base portion to form a shuttlecock. Each of the artificial feathers includes a connecting portion and a resistance portion. The connecting portion connects to one of the stems. The resistance portion connects to the connecting portion, and the resistance portion includes a plurality of low-wind-resistance areas and a high-wind-resistance area. The low-wind-resistance areas are surrounded by the high-wind-resistance area.

20 Claims, 2 Drawing Sheets

SHUTTLECOCK AND ARTIFICIAL FEATHER THEREOF

BACKGROUND OF THE INVENTION

1. Field of the Invention

The present invention relates to an artificial feather and, particularly, to artificial feathers for a shuttlecock.

2. Description of the Related Art

Badminton is a common and popular racket sport. Badminton gameplay involves a player using a racket to hit a shuttlecock. The structure of the conventional shuttlecock is such that natural feathers are embedded into a rounded cock base. Most of these natural feathers are collected from geese or ducks, and after being bleached, the proper natural feathers are selected to make a shuttlecock.

However, only a miniscule number of waterfowl feathers can be selected to make a shuttlecock. As a result, collecting the proper natural feathers is not easy, so shuttlecocks with artificial feathers, herein referred to as synthetic shuttlecocks, are provided to solve the problem of the insufficiently of natural feathers. Most current synthetic shuttlecock designs replace the natural feathers with a plastic skirt made of nylon resin. The plastic skirt is a hollow structure so that the air current can pass through the plastic skirt. However, for the player, the feeling of hitting a synthetic shuttlecock is still different from that of hitting a natural feather shuttlecock, so most badminton players still use natural shuttlecocks.

SUMMARY OF THE INVENTION

It is a major objective of the present invention to provide an artificial feather for a shuttlecock, and the low-wind-resistance areas of the artificial feather can simulate the feeling of hitting a natural feather shuttlecock.

To achieve the major objective described above, a plurality of artificial feathers for a shuttlecock is provided in the present invention. The artificial feathers connect to a plurality of stems and a base portion to form the shuttlecock. Each of the artificial feathers comprises a connecting portion and a resistance portion. The connecting portion connects to one of the stems. The resistance portion connects to the connecting portion, and the resistance portion comprises a plurality of low-wind-resistance areas and a high-wind-resistance-area. The low-wind-resistance areas are surrounded by the high-wind-resistance area.

To achieve another objective described above, a shuttlecock is provided in the present invention. The shuttlecock comprises a base portion, a plurality of stems and a plurality of artificial feathers. One end of the stems is inserted to the base portion, and the artificial feathers connect to the other end of the stems respectively. Each of the artificial feathers comprises a connecting portion and a resistance portion. The connecting portion connects to one of the stems. The resistance portion connects to the connecting portion, and the resistance portion comprises a plurality of low-wind-resistance areas and a high-wind-resistance area. The low-wind-resistance areas are surrounded by the high-wind-resistance area.

In an embodiment of the present invention, the connecting portion is long and straight, and one end of the connecting portion connects to the stem.

In an embodiment of the present invention, the connecting portion is surrounded by the high-wind-resistance area, the resistance portion has a plurality of virtual reference lines, and the low-wind-resistance areas are placed on the reference lines.

In an embodiment of the present invention, an angle between the reference line and the connecting portion is between 40 degrees and 80 degrees.

In an embodiment of the present invention, the angle between the reference lines and the connecting portion is 65 degrees.

In an embodiment of the present invention, the length of each of the low-wind-resistance areas is between 0.3 mm and 2.6 mm.

In an embodiment of the present invention, the artificial feather is made from plastic material or glass fiber, the density of the plastic material is between 0.9 g/cm3 and 1.48 g/cm3, and the density of the glass fiber is between 1.4 g/cm3 and 1.9 g/cm3.

In an embodiment of the present invention, the high-wind-resistance area is penetrated by a needle rod to form the low-wind-resistance areas.

In an embodiment of the present invention, the shape of the artificial feather is the shape of a kite. The artificial feather has a longer diagonal and a shorter diagonal, the length of the longer diagonal is between 30 mm and 45 mm, and the length of the shorter diagonal is between 10 mm and 20 mm. The space between two of the neighboring reference lines is between 1 mm and 21 mm.

In an embodiment of the present invention, the area of each of the low-wind-resistance areas is smaller than or equal to 22 mm2.

According to the embodiments described above, the artificial feather of the present invention has at least the following advantages: when the shuttlecock is hit and flies, the high-wind-resistance area and the low-wind-resistance areas of the artificial feather generate different types of wind drag similar to the types of drag of the natural feather shuttlecock, such that the feeling of hitting the synthetic shuttle cock resembles that of hitting the natural feather shuttlecock.

DETAILED DESCRIPTION OF THE PREFERRED EMBODIMENTS

Hereafter, the technical content of the present invention will be better understood with reference to preferred embodiments.

Figure 1:
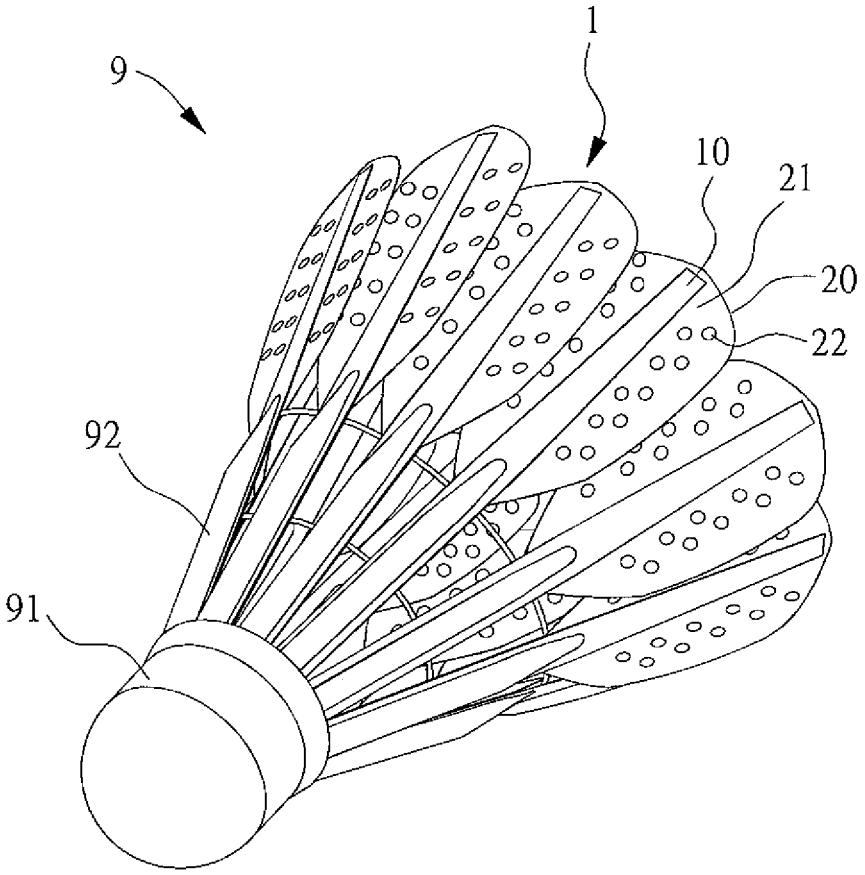
FIG. 1 presents a schematic drawing of a shuttlecock according to an embodiment of the present invention.

FIG. 1 presents a schematic drawing of a shuttlecock according to an embodiment of the present invention. The shuttlecock 9 is made of the artificial feathers 1 with a particular structure such that the feeling of hitting the shuttlecock 9 is similar to the feeling of hitting the natural feather shuttlecock. Each of the artificial feathers 1 connects to a stem 92, and the stems 92 are inserted into the base portion 91 to form a shuttlecock 9. In other words, one end of the stem 92 is inserted into the base portion 91, and the artificial feather 1 is disposed on another end of the stem 92.

In the present embodiment, the artificial feather 1 consists of a plastic material or glass fiber. The density of the plastic material is between 0.9 g/cm$^3$ and 1.48 g/cm$^3$, and the density of the glass fiber is between 1.4 g/cm$^3$ and 1.9 g/cm$^3$. For example, low density polyethylene (LDPE), polyethylene terephthalate (PET), polyethylene (PE), polypropylene (PP), acrylonitrile-butadiene-styrene (ABS), polyimide (PA), extruded polyethylene (EPE) and the like can be used as the plastic material. The configuration of the artificial feather 1 is approximately similar to the configuration of a feather of the natural feather shuttlecock. In other words, the configuration of the artificial feather 1 is approximately kite-shaped. The artificial feather 1 comprises a connecting portion 10 and a resistance portion 20. The connecting portion 10 is long and straight and corresponds to the shape of the stems 92. The resistance portion 20 is disposed on two sides of the connecting portion 10. The shape of the resistance portion 20 of each side is approximately an obtuse triangle, and the obtuse angle is between 95 degrees and 135 degrees. Preferably, the obtuse angle is between 110 degrees and 135 degrees. The configuration of the resistance portion 20 disposed on two sides of the connecting portion 10 can be symmetrical or non-symmetrical. The maker can adjust the configuration of the artificial feathers 1 to satisfy the needs of various players. In the case of the non-symmetrical resistance portion 20, one side of the resistance portion 20 is a narrow side, and another side of the resistance portion 20 is a broad side. The configuration of the narrow side is similar to a line shape, and the configuration of the broad side is similar to an arc shape. In the case of the symmetrical resistance portion 20, the configuration of two sides of the resistance portion 20 is similar to an arc shape.

Figure 2:
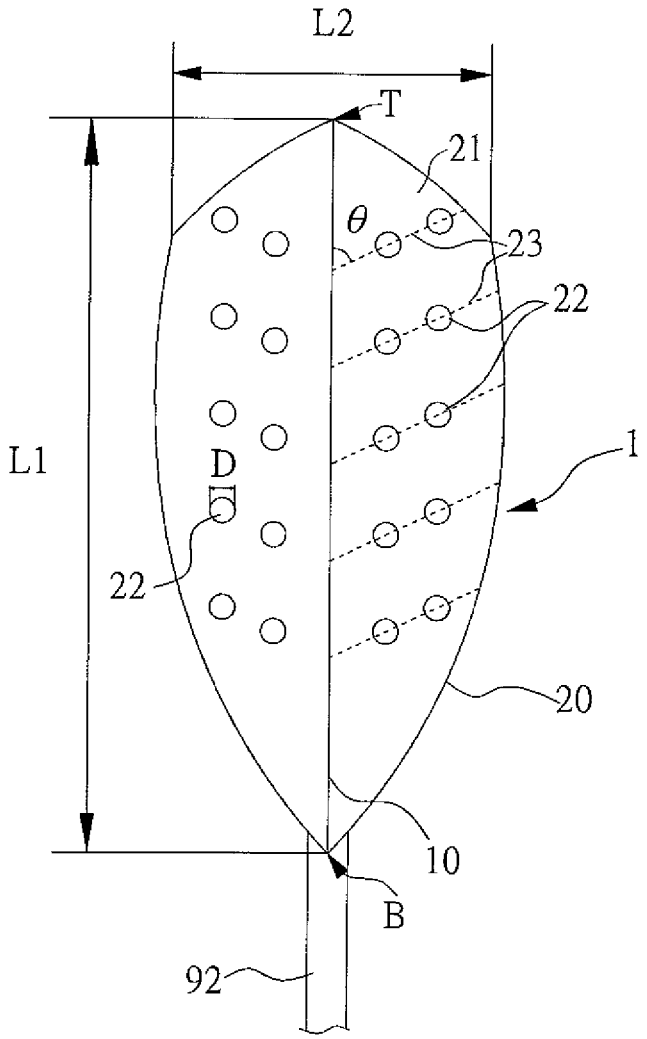
FIG. 2 is a schematic drawing of an artificial feather shown in FIG. 1.

Please refer to FIG. 2. In the present embodiment, the resistance portion 20 disposed on two sides of the connecting portion 10 is symmetrical, and the configuration of the artificial feather 1 is similar to a kite shape having a smooth curve. The diagonal L1 is longer than the diagonal L2. In the present embodiment, the connecting portion 10 corresponds to the longer diagonal L1 of the artificial feather 1. The length of the longer diagonal L1 is between 30 mm and 45 mm, and a preferred length is 38 min. The length of the shorter diagonal L2 is between 10 mm and 20 mm, and a preferred length is 13.5 mm to 17 mm. The thickness of the artificial feather 1 is between 0.2 mm and 1.8 mm, and the preferred thickness is 0.6 mm to 1.8 mm. The maker can adjust the area and the thickness of the artificial feather 1 to vary the balance, weight and wind resistance. In another embodiment, the configuration of the artificial feather 1 can be an ellipse or a polygon. The present invention is not limited thereto.

The resistance portion 20 comprises a high-wind-resistance area 21 and a plurality of low-wind-resistance areas 22, and the low-wind-resistance areas 22 are surrounded by the high-wind-resistance area 21. In the present embodiment, one of the low-wind-resistance areas 22 can be made by a needle rod (FIG. not shown) penetrating the high-wind-resistance area 21. In other words, the high-wind-resistance area 21 can be penetrated by a needle rod to form the low-wind-resistance areas 22. When the high-wind-resistance area 21 is penetrated by the needle rod, the fibers of the artificial feather 1 are pushed by the needle rod to form a hole, and some torn fibers remain. Both the hole and the residual fibers compose the low-wind-resistance areas 22 of the present embodiment. In another embodiment, the low-wind-resistance areas 22 can also be made by a cutting tool directly cutting off parts of the fibers of the high-wind-resistance area 21. The present invention is not limited to the shape of the blade, such as flat or cylindrical, to form low-wind-resistance areas 22 having different shapes. The difference between using the needle rod and the cutting tool is whether the low-wind-resistance area 22 is to have residual fibers or not.

Specifically, the production process of the artificial feather 1 comprises the following steps: producing an artificial feather 1 having only the high-wind-resistance area 21; and then penetrating the high-wind-resistance area 21 with the needle rod or the cutting tool to form holes or incisions, which are the low-wind-resistance areas 22. Therefore, the low-wind-resistance areas 22 are surrounded by the high-wind-resistance area 21. The difference between the high-wind-resistance area 21 and the low-wind-resistance area 22 is the fiber density of the artificial feather 1, such that the high-wind-resistance area 21 and the low-wind-resistance area 22 generate different amounts of wind resistance when the shuttlecock 9 is hit or flies. According to the production processes described above, the low-wind-resistance area 22 can be a hole or an incision, and the present invention is not limited to the shape of the hole. The hole can be circular, rhomboid, pentalobal, polygonal, elliptical, rectangular or another shape, and the shape of the hole is based on the configuration of the needle rod or the blade of the cutting tool. Moreover, the length of the low-wind-resistance area 22 is between 0.3 mm and 2.6 mm. Specifically, the diameter D of the circular low-wind-resistance area 22 and the maximal length of low-wind-resistance areas 22 of other shapes are between 0.3 mm and 2.6 mm. Preferably, whether the low-wind-resistance area 22 is a circular hole or a linear incision, the area of the low-wind-resistance area 22 is smaller than or equal to 22 mm$^2$.

Moreover, the distribution of the low-wind-resistance areas 22 is relative to the position of the connecting portion 10. In the production processes, the maker can set a plurality of virtual reference lines 23 on the resistance portion 20 before the high-wind-resistance area 21 is penetrated with the needle rod or the cutting tool. The reference lines 23 are used to mark the preferable distribution, so the reference lines 23 can be virtual or real lines. The present invention is not limited thereto. The angle θ between a reference line 23 and the connecting portion 10 is between 40 degrees and 80 degrees. In the present embodiment, the angle θ is 65 degrees. The value of the angle θ is based on the angle between the barb and the rachis of the natural feather. The maker can adjust the angle θ according to wind tunnel experiments. Therefore, when the shuttlecock 9 is hit, the air flow pattern of the shuttlecock 9 will resemble the air flow pattern of the natural feather shuttlecock. For example, the angle θ is between 50 degrees and 80 degrees if, in one embodiment, the shorter diagonal L2 of the artificial feather 1 is between 3 mm and 11 mm. The angle θ is between 40 degrees and 70 degrees if, in another embodiment, the shorter diagonal L2 of the artificial feather 1 is between 10 mm and 20 mm.

Moreover, the reference lines 23 are disposed with intervals on the resistance portion 20, and the maker defines two ends of the longer diagonal L1 of the artificial feather 1 as a top end T and a bottom end B. The distance from the top end T to the reference lines 23 closest to the top end T is between 6 min and 9 mm, and the distance from the bottom end B to the reference lines 23 closest to the bottom end B is between 6 mm and 9 mm. Preferably, the distance is 7 mm. Moreover, the intervals of the adjoining two reference lines 23 are between 1 mm and 21 mm. Preferably, the interval of the adjoining two reference lines 23 is 7 mm if the length of the shorter diagonal L2 of the artificial feather 1 is between 3 mm and 11 mm. The maker can adjust the interval of the adjoining two reference lines 23 based on the wind resistance coefficient. For example, the interval could also be 3.5 mm. The interval of the adjoining two reference lines 23 is between 2.5 mm and 3.5 mm if the length of the shorter diagonal L2 of the artificial feather 1 is between 10 mm and 20 mm.

After the reference lines 23 are set, the needle rod penetrates through the resistance portion 20 along the reference lines 23 to form the low-wind-resistance areas 22. In other words, the low-wind-resistance areas 22 of the resistance portion 20 are disposed on the reference lines 23. The number of the low-wind-resistance areas 22 disposed on the resistance portion 20 is between 5 and 40. Preferably, the number of the low-wind-resistance areas 22 is 30.

As described above, the artificial feather of the present invention has at least the following advantages: When the shuttlecock is hit and flies, the high-wind-resistance area and the low-wind-resistance areas of the artificial feather generate different types of wind drag similar to the types of wind drag of a natural feather shuttlecock such that the feeling of hitting the synthetic shuttlecock and the speed and flying stability of the synthetic shuttlecock are similar to those of the natural feather shuttlecock.

It should be specifically noted that the objective, means, and efficiency of the present invention are all different from conventional characteristics in the prior art. It should also be noted that the described embodiments are only for illustrative and exemplary purposes, and that various changes and modifications may be made to the described embodiments without departing from the scope of the invention as disposed by the appended claims.

What is claimed is:

1. A plurality of artificial feathers for a shuttlecock; wherein the plurality of artificial feathers connects to a plurality of stems and a base portion to form the shuttlecock, with each of the plurality of artificial feathers comprising:

a connecting portion connected to one of the plurality of stems spaced from the base portion; and a resistance portion connected to the connecting portion and extending opposite the base portion, with the resistance portion comprising a plurality of low-wind-resistance areas and a high-wind-resistance area, with the plurality of low-wind-resistance areas surrounded by the high-wind-resistance area, wherein the plurality of low-wind-resistance areas is between 5 and 40, and wherein the plurality of stems is free of interconnection between the base portion and the connecting portions of the plurality of artificial feathers.

2. The plurality of artificial feathers as claimed in claim 1, wherein a length of each of the plurality of low-wind-resistance areas is between 0.3 mm and 2.6 mm, wherein the resistance portion is made from a plastic material or a glass fiber, the density of the plastic material is between 0.9 g/cm$^3$ and 1.48 g/cm$^3$, and the density of the glass fiber is between 1.4 g/cm$^3$ and 1.9 g/cm$^3$.

3. The plurality of artificial feathers as claimed in claim 2, wherein the connecting portion is long and straight, and wherein one end of the connecting portion connects to the stem.

4. The plurality of artificial feathers as claimed in claim 3, wherein the connecting portion is surrounded by the high-wind-resistance area, the resistance portion has a plurality of virtual reference lines, and the plurality of low-wind-resistance areas is placed on the plurality of reference lines.

5. The plurality of artificial feathers as claimed in claim 4, wherein an angle between the plurality of reference lines and the connecting portions of the plurality of artificial feathers is between 40 degrees and 80 degrees.

6. The plurality of artificial feathers as claimed in claim 5, wherein the angle between the plurality of reference lines and the connecting portions of the plurality of artificial feathers is 65 degrees.

7. The plurality of artificial feathers as claimed in claim 2, wherein the high-wind-resistance area is penetrated by a needle rod to form the plurality of low-wind-resistance areas.

8. The plurality of artificial feathers as claimed in claim 7, wherein a shape of each artificial feather is the shape of a kite; wherein each artificial feather has a longer diagonal and a shorter diagonal, a length of the longer diagonal is between 30 mm and 45 mm, a length of the shorter diagonal is between 10 mm and 20 mm, and a space between two of neighboring reference lines is between 1 mm and 21 mm.

9. The plurality of artificial feathers as claimed in claim 2, wherein an area of each of the plurality of low-wind-resistance areas is smaller than or equal to 22 mm$^2$.

10. The plurality of artificial feathers as claimed in claim 1, wherein the high-wind resistance area includes an annular periphery with the connecting portion intersecting the annular periphery, with the low-wind resistance areas including holes located within and spaced from the annular periphery and on opposite sides of the connecting portion, with all of the holes within the annular periphery being of a same size.

11. A shuttlecock comprising:

a base portion;

a plurality of stems, wherein one end of each of the plurality of stems is inserted into the base portion; and a plurality of artificial feathers connected to other ends of the plurality of stems respectively, with each of the plurality of artificial feathers comprising:

a connecting portion connected to one of the plurality of stems spaced from the base portion; and a resistance portion connected to the connecting portion and extending opposite the base portion, with the resistance portion comprising a plurality of low-wind-resistance areas and a high-wind-resistance area, with the plurality of low-wind-resistance areas surrounded by the high-wind-resistance area, wherein the plurality of low-wind-resistance areas is between 5 and 40, and wherein the plurality of stems is free of interconnection between the base portion and the connecting portions of the plurality of artificial feathers.

12. The shuttlecock as claimed in claim 11, wherein the length of each of the low-wind-resistance areas is between 0.3 mm and 2.6 mm, wherein the artificial feather is made from a plastic material or a glass fiber, the density of the plastic material is between 0.9 g/cm$^3$ and 1.48 g/cm$^3$, and the density of the glass fiber is between 1.4 g/cm$^3$ and 1.9 g/cm$^3$.

13. The shuttlecock as claimed in claim 12, wherein the connecting portion is long and straight, and wherein one end of the connecting portion connects to the stem.

14. The shuttlecock as claimed in claim 13, wherein the connecting portion is surrounded by the high-wind-resistance area, the resistance portion has a plurality of virtual reference lines, and the plurality of low-wind-resistance areas is placed on the plurality of reference lines.

15. The shuttlecock as claimed in claim 14, wherein an angle between the plurality of reference lines and the connecting portions of the plurality of artificial feathers is between 40 degrees and 80 degrees.

16. The shuttlecock as claimed in claim 15, wherein the angle between the plurality of reference lines and the connecting portions of the plurality of artificial feathers is 65 degrees.

17. The shuttlecock as claimed in claim 12, wherein the high-wind-resistance area is penetrated by a needle rod to form the plurality of low-wind-resistance areas.

18. The shuttlecock as claimed in claim 17, wherein a shape of the artificial feather is the shape of a kite, wherein the artificial feather has a longer diagonal and a shorter diagonal, a length of the longer diagonal is between 30 mm and 45 mm, a length of the shorter diagonal is between 10 mm and 20 mm, and a space between two neighboring reference lines is between 1 mm and 21 mm.

19. The shuttlecock as claimed in claim 12, wherein an area of each of the plurality of low-wind-resistance areas is smaller than or equal to 22 $mm^2$.

20. The shuttlecock as claimed in claim 11, wherein the high-wind resistance area includes an annular periphery with the connecting portion intersecting the annular periphery, with the low-wind resistance areas including holes located within and spaced from the annular periphery and on opposite sides of the connecting portion, with all of the holes within the annular periphery being of a same size.

* * * * *